US006355087B1

(12) United States Patent
Arvidsson et al.

(10) Patent No.: US 6,355,087 B1
(45) Date of Patent: Mar. 12, 2002

(54) PROCESS OF PREPARING AN IRON-BASED POWDER IN A GAS-TIGHT FURNACE

(75) Inventors: Johan Arvidsson, Nyhamnsläge; Ola Eriksson, Höganäs, both of (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/618,725

(22) Filed: Jul. 18, 2000

Related U.S. Application Data

(63) Continuation of application No. PCT/SE99/00093, filed on Jan. 21, 1999.

(30) Foreign Application Priority Data

Jan. 21, 1998 (SE) ..... 9800153

(51) Int. Cl.[7] ..... B22F 9/04
(52) U.S. Cl. ..... 75/338; 75/351; 75/385
(58) Field of Search ..... 75/338, 351, 384, 75/385

(56) References Cited

U.S. PATENT DOCUMENTS

| | | | | |
|---|---|---|---|---|
| 3,666,439 A | * | 5/1972 | Ramachandran | 75/385 |
| 3,887,402 A | | 6/1975 | Kondo et al. | |
| 4,148,629 A | * | 4/1979 | Kammerhofer | 75/384 |
| 4,209,320 A | | 6/1980 | Kajinaga et al. | |
| 4,251,269 A | * | 2/1981 | Hoshi et al. | 75/385 |
| 4,448,746 A | | 5/1984 | Kubo et al. | |
| 5,162,099 A | | 11/1992 | Meyer et al. | |

FOREIGN PATENT DOCUMENTS

| | | | | |
|---|---|---|---|---|
| EP | 0503326 | | 9/1992 | |
| JP | 59-31812 | * | 2/1984 | 75/385 |
| JP | 61-257409 | * | 11/1986 | 75/385 |
| JP | 4-28813 | * | 1/1992 | 75/385 |

OTHER PUBLICATIONS

Derwent's Abstract, No. 41111 C/23, Week 8023, Abstract of Su, 692–695 (AS UKR MAT RES INST), Oct. 25, 1979.
Derwent's Abstract, No. 23408, Week 80013, Abstract of SU, 676–384 (Tulachermet PROD), Jul. 30, 1979.
Chemical Abstracts, vol. 98, No. 24, Jun. 13, 1983, (Columbus, Ohio, USA) Pekach, V.F. et al, "Thermodynamic study of reduction–decarburization annealing of iron powders in an autogenous atmosphere", The Abstract No. 202156q, Poroshk.Metall 1983, 3, 6–10.
Chemical Abstracts, vol. 67, No. 7, Aug. 14, 1967, (Columbus, Ohio, USA), V.F. Knyazev et al, "Quality of iron powder obtained by reduction with solid carbon in capsules", The Abstract No. 35036b, Porosh.Met. 1966, 59–63.

* cited by examiner

*Primary Examiner*—George Wyszomierski
(74) *Attorney, Agent, or Firm*—Burns, Doane, Swecker & Mathis, L.L.P.

(57) ABSTRACT

The invention concerns a low pressure for the preparation of an iron-based, optionally alloyed powder comprising the steps of preparing a raw powder essentially consisting of iron and optionally at least one alloying element selected from the group consisting of chromium, manganese, copper, nickel, vanadium, niobium, boron, silicon, molybdenum and tungsten; charging a gas tight furnace with the powder in an essentially inert gas atmosphere and closing the furnace; increasing the furnace temperature; monitoring the increase of the formation of CO gas and evacuating gas from the furnace when a significant increase of the CO formation is observed and cooling the powder when the increase of the formation of CO gas diminishes.

23 Claims, 3 Drawing Sheets

PROCESS OF PREPARING AN IRON-BASED POWDER IN A GAS-TIGHT FURNACE

This is a continuation of International Application No. PCT/SE99/00093, filed Jan. 21, 1999, that designates the United States of America and claims priority from Swedish Application No. 9800153-0, filed Jan. 21, 1998.

FIELD OF THE INVENTION

The present invention concerns a low-pressure process for preparing an iron-based powder. More specifically, the invention concerns an annealing process for producing a low-oxygen, low-carbon iron or steel powder.

BACKGROUND OF THE INVENTION

Annealing of iron powders is of central importance in the manufacture of powder metallurgical powders.

Previously known processes aiming at the production of low-oxygen, low-carbon iron-based powder are disclosed in e.g., U.S. Pat. Nos. 3,887,402; 4,448,746 and 4,209,320.

U.S. Pat. No. 3,887,402 concerns a process for the production of high density steel powders, wherein a molten stream of low carbon steel or low carbon alloy steel is atomised by high pressure water jet or inert gas jet to form powders, and after drying, the powders are heated in such inert gas as nitrogen or argon, whereby the reduction, decarburisation and softening of the powders are simultaneously carried out.

U.S. Pat. No. 4,448,746 concerns a process for the production of an alloyed steel powder having low amounts of oxygen and carbon. In this process, the amount of carbon of an atomised powder is controlled by keeping the powder in a decarburising atmosphere, which comprises at least $H_2$ and $H_2O$ gases during certain periods of treatment, which are determined by temperature and pressure conditions. The amount of oxygen of the starting powder is essentially the same or somewhat lower than that of the annealed powder.

U.S. Pat. No. 4,209,320 discloses a process for the preparation of low oxygen iron-base metallic powder by using induction heating. In order to obtain powders having both a low oxygen and a low carbon content this patent teaches that so called rough reduced iron powders obtained by reducing mill scale with coke should be used. If the raw powder is a water-atomised powder high carbon levels are obtained.

Another process for producing steel powders having low amounts of oxygen and carbon is disclosed in the co-pending application PCT SE 97/0129.

Summary of the Invention

The present invention concerns an alternative process for the preparation of steel powders having low amounts of oxygen and carbon or more specifically less than 0.25% by weight of oxygen and less than 0.01% by weight of carbon.

A distinguishing feature of the new process is it provides simple and effective process monitoring and that it can be carried out in a conventional batch furnace, which is preferably heated by direct electrical or gas heating even though it is possible to perform the process by induction heating.

Another distinguishing feature is that the process is carried out at low pressure.

In brief, the process according to the invention includes the following steps a) water-atomising a raw powder essentially consisting of iron and optionally at least one alloying element selected from the group consisting of chromium, manganese, copper, nickel, vanadium, niobium, boron, silicon, molybdenum and tungsten and having a carbon content between 0.1 and 0.9, preferably between 0.2 and 0.7% by weight and an oxygen/carbon weight ratio of about 1 to 3, preferably between 1 and 1.5 and at most 0.5% of impurities;

b) charging a gas tight furnace with the powder in an essentially inert gas atmosphere and closing the furnace;

c) increasing the furnace temperature to a temperature between 800 and 1350° C., d) monitoring the increase of the formation of CO gas and evacuating gas from the furnace when a significant increase of the CO formation is observed; and cooling the powder when the increase of the formation of CO gas diminishes.

DETAILED DESCRIPTION OF THE INVENTION

Figure 1:
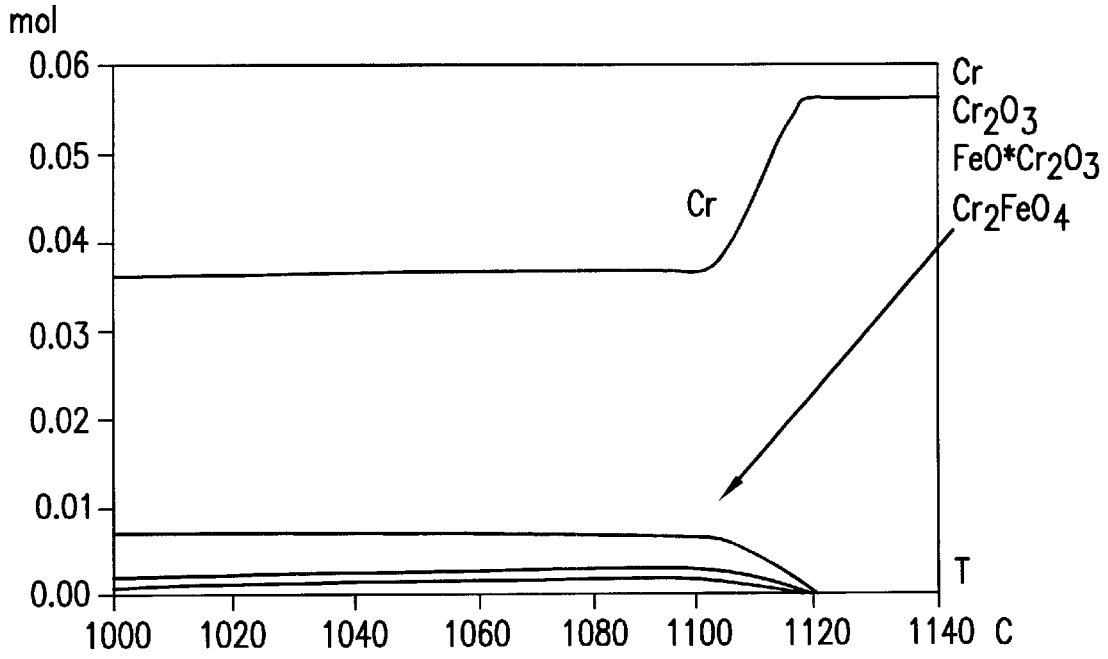
FIG. 1 is a graph of mol versus temperature for a process of annealing iron powder at a furnace pressure of 1 bar.

The starting material for the annealing process, the so-called raw powder, consists of iron powder and optionally alloying elements, which have been alloyed with the iron in connection with the melting process. In addition to optional alloying elements, the raw powder usually includes the impurities carbon and oxygen in concentration ranges 0.2<% C<0.5 and 0.3<% O-tot<1.0 and minor amounts of sulphur and nitrogen. In order to obtain as good powder properties as possible, it is of outmost importance to eliminate as much as possible of these impurities, which is an important purpose of the annealing process according to the present invention. Even though the starting powder can be essentially any iron-based powder containing too high amounts of carbon and oxygen, the process is especially valuable for reducing powders containing easily oxidisable elements, such as Cr, Mn, V, Nb, B, Si, Mo, W etc. The raw powder used is preferably a water atomised powder. Optionally the starting powder is pre-alloyed.

According to a preferred embodiment the starting powder is a water-atomised, iron-based powder, which in addition to iron comprises at least 1% by weight of an element selected from the group consisting of chromium, molybdenum, copper, nickel, vanadium, niobium, manganese and silicon and has a carbon content between 0.1 and 0.9, preferably between 0.2 and 0.7% by weight and an oxygen/carbon weight ratio of about 1 to 4, preferably between 1,5 and 3.5 and at most preferably between 2 and 3, and not more than 0.5% of impurities.

The method according to the present invention is preferably used for preparing a water-atomised, annealed iron-based powder comprising, by weight %, Cr 2.5–3.5, Mo 0.3–0.7,Mn>0.08, O<0.2, C<0.01 the balance being iron and, an amount of not more that 0.5%, inevitable impurities.

In order to obtain the low contents of oxygen and carbon in the annealed powder it is essential that the ratio oxygen/carbon in the raw powder is correct. If this ratio is too low graphite can be added to the raw powder in the required amount, i.e. until the correct ratio is obtained.

The powder may be charged in the furnace on conventional trays and when the furnace has been closed the air atmosphere is evacuated and an inert gas, such as argon or nitrogen, is pumped into the furnace. The furnace temperature is then increased and the formation of CO is then monitored by e.g. an IR probe. When a significant increase of the formation of CO is registered the furnace gas is evacuated to a pre-set pressure of e.g. 0.01 to 0.5 bar, preferably 0.05 to 0.08 bar. Optionally 1–5% by $H_2$ can be added during the heating step in order to avoid oxidation.

According to an embodiment of the invention $H_2O$ is added in step d) when the pressure drops. This is of particular interest when carbon is present in molar excess in relation to oxygen in the water-atomised powder.

Normally the furnace temperature is raised to a value between 800 and 1200° C. For alloyed powders the temperature preferably varies between 950 and 1200° C., whereas the process temperature for essentially pure iron powders preferably varies between 850 and 1000° C. It is however also possible to process essentially pure iron powders at higher temperatures, e.g. temperatures between 950 and 1200° C.

The evacuation of the furnace gases, which as the reaction proceeds, contain more and more CO, accelerates the reduction of the powder. When the CO monitoring device shows that the increase of the CO formation has stopped the powder is cooled, preferably after the CO gas has been evacuated and replaced by an inert gas, such as argon or nitrogen. Optionally 1–5% by $H_2$ can be added also during the cooling step in order to avoid oxidation.

Before charging the furnace the powder can be mixed or agglomerated with an inert material such as stable oxides, such as silicon oxide, manganese oxide or chromium oxide, which are not participating in the annealing process but which prevents the welding together of the powder particles. This inert material has to be separated from the iron-based powder after the annealing process.

The process is further illustrated by the following example:

4 tons of a water-atomised iron powder containing 3% by weight of Cr, 0.5% by weight of Mo, 0.4% by weight of C and 0.55% by weight of O was charged into a conventional batch furnace on trays and the furnace was connected to an IR probe, a pressure gauge and a pump. The furnace was evacuated and filled with argon gas including at most a few ppm oxygen. The temperature was increased to 975° C. where a significant increase of the formation of CO could be observed. The furnace was then evacuated to 0.1 bar until the increase of the formation of CO ceased, which was an indication that the reaction was completed and that all carbon had been consumed. The furnace gases were then evacuated and replaced by inert gas before cooling of the powder.

After this low pressure annealing, the powder was ground and sieved to a particle size of less than 200 $\mu$m. The obtained powder had a C content of 0.005 and an O content of 0.10% by weight. The AD was 2.85 g/cm$^3$ and the GD (lubricated die) was 7.05 g/cm$^3$.

Figure 2:
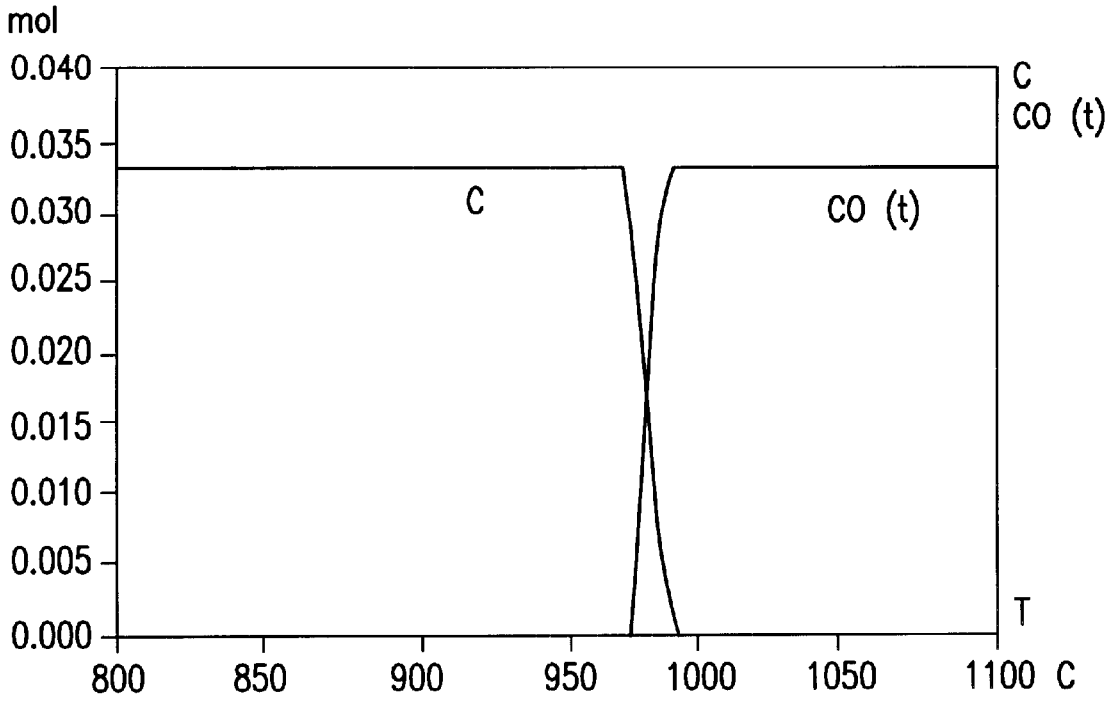
FIG. 2 is a graph of mol versus temperature for a process of annealing iron powder at a furnace pressure of 0.1 bar.
Figure 2A:
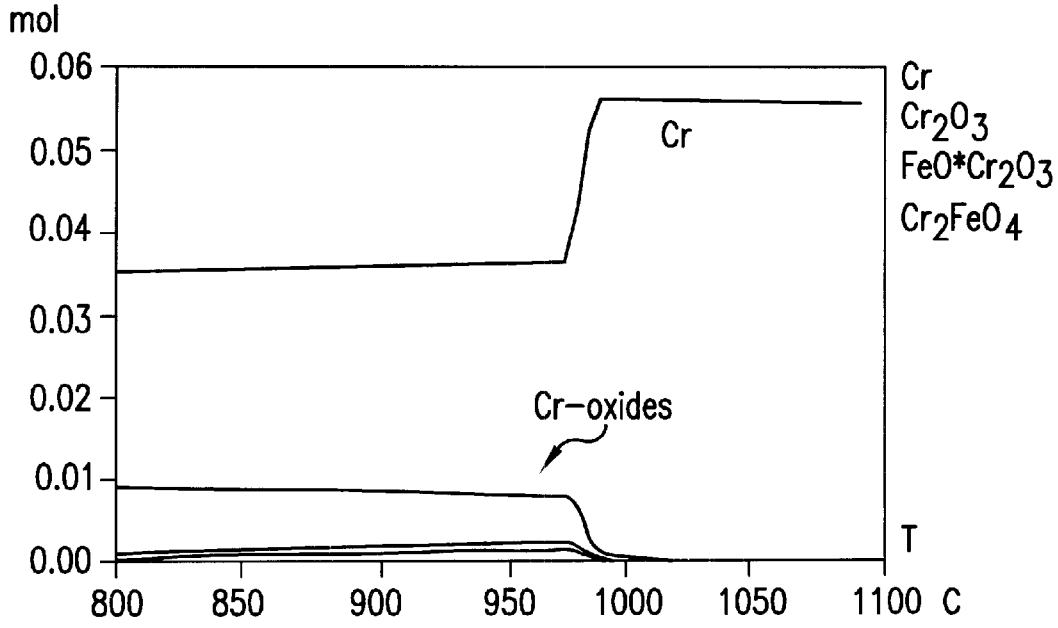
FIG. 2A is a graph of mol versus temperature for a process of annealing iron powder at a furnace pressure of 0.1 bar.

The temperature difference between annealing at a pressure of 1 bar, 0.1 bar and 0.1 bar can be seen on the enclosed FIGS. 1, 2 and 2A, respectively.

The data set forth in FIG. 1 was generated under the following conditions:

| | |
|---|---|
| Temperature | 1273.150 K |
| Pressure | 1.000 bar |
| Raw material | mol |
| CO(g) | 1.0000E − 06 |
| $Cr_2O_3$ | 1.0000E − 02 |
| $FeO*Cr_2O_3$ | 4.4000E − 04 |
| $Cr_2FeO_4$ | 2.0000E − 04 |
| FeO | 2.4400E − 03 |
| Cr | 3.6300E − 02 |
| Fe | 1.6730E + 00 |
| Mo | 5.2000E − 03 |
| C | 3.3300E − 02 |

The data set forth in FIG. 2 was generated under the following conditions:

| | |
|---|---|
| Temperature | 1073.150 K |
| Pressure | 0.100 bar |
| Raw material | mol |
| CO(t) | 1.0000E − 06 |
| $Cr_2O_3$ | 1.0000E − 02 |
| $FeO*Cr_2O_3$ | 4.4000E − 04 |
| $Cr_2FeO_4$ | 2.0000E − 04 |
| FeO | 2.4400E − 03 |
| Cr | 3.6300E − 02 |
| Fe | 1.6730E + 00 |
| Mo | 5.2000E − 03 |
| C | 3.3300E − 02 |

The data set forth in FIG. 2A was generated under the following conditions:

| | |
|---|---|
| Temperature | 1073.150 K |
| Pressure | 0.100 bar |
| Raw material | mol |
| CO(t) | 1.0000E − 06 |
| $Cr_2O_3$ | 1.0000E − 02 |
| $FeO*Cr_2O_3$ | 4.4000E − 04 |
| $Cr_2FeO_4$ | 2.0000E − 04 |
| FeO | 2.4400E − 03 |
| Cr | 3.6300E − 02 |
| Fe | 1.6730E + 00 |
| Mo | 5.2000E − 03 |
| C | 3.3300E − 02-- |

This example discloses that an efficient annealing at a considerably lower temperature is obtained by using the new low pressure process according to the present invention.

What is claimed is:

1. A process of preparing an iron-based powder having less than 0.25% by weight of oxygen and less than 0.01% by weight of carbon comprising the steps of a) water-atomising a raw powder consisting essentially of iron and optionally at least one alloying element selected from the group consisting of chromium, managanese, copper, nickel, vanadium, niobium, boron, silicon, molybdenum and tungsten and having a carbon content between 0.1 and 0.9% by weight and an oxygen/carbon weight ratio of about 1 to 4 and at most 0.5% of impurities;

b) charging a gas tight furnace with the powder in essentially inert gas atmosphere and closing the furnace;

c) increasing the furnace temperature to a temperature between 800 and 1350° C.

d) monitoring the increase of the formation of CO gas in the furnace and evacuating gas from the furnace when a significant increase of the CO formation is observed; and e) cooling the powder when the increase of the formation of CO gas diminishes.

2. The process according to claim 1, wherein the temperature is increased by direct electrical or gas heating.

3. The process according to claim 2, wherein the furnace is filled with an inert gas before the powder is cooled.

4. The process according to claim 2, wherein $H_2O$ is added in step d) when pressure drops in the furnace and carbon is present in molar excess in relation to oxygen in the water-atomised powder.

5. The process according to claim 2, wherein the powder comprises, by weight %, Cr 2.5–3.5, Mo 0.3–0.7, Mn>0.08, O<0.25 and C<0.01, the balance being iron and inevitable impurities.

6. The process according to claim 2, wherein the process is performed in a batch furnace.

7. The process according to claim 2, wherein before it is charged into the furnace, the powder is mixed or agglomerated with an inert material which is later separated from the powder after subjecting the powder to an annealing process.

8. The process according to claim 1, wherein the furnace is filled with an inert gas before the powder is cooled.

9. The process according to claim 8, wherein $H_2O$ is added in step d) when pressure drops in the furnace and carbon is present in molar excess in relation to oxygen in the water-atomised powder.

10. The process according to claim 8, wherein the powder comprises, by weight %, Cr 2.5–3.5, Mo 0.3–0.7, Mn>0.08, O<0.25 and C<0.01, the balance being iron and inevitable impurities.

11. The process according to claim 8, wherein the process is performed in a batch furnace.

12. The process according to claim 8, wherein before it is charged into the furnace, the powder is mixed or agglomerated with an inert material which is later separated from the powder after subjecting the powder to an annealing process.

13. The process according to claim 1, wherein $H_2O$ is added to step d) when pressure drops in the furnace and carbon is present in molar excess in relation to oxygen in the water-atomised powder.

14. The process according to claim 13, wherein the powder comprises, by weight %, Cr. 2.5–3.5, Mo 0.3–0.7, Mn>0.08, O<0.25 and C<0.01, the balance being iron and inevitable impurities.

15. The process according to claim 3, wherein the process is performed in a batch furnace.

16. The process according to claim 1, wherein after step e) the powder comprises, by weight %, Cr 2.5–3.5, Mo 0.3–0.7, Mn>0.08, O<0.25 and C<0.01, the balance being iron and inevitable impurities.

17. The process according to claim wherein the powder comprises, by weight %, Cr 2.5–3.5, Mo 0.3–0.7, Mn 0.09–0.3, Cu<0.10, Ni<0.15, P<0.02, N<0.01, V<0.10, Si<0.10, O<0.25 and C<0.01, the balance being iron and inevitable impurities in an amount of not more than 0.5%.

18. The process according to claim 1, wherein the process is performed in a batch furnace.

19. The process according to claim 1, wherein before it is charged into the furnace, the powder is mixed or agglomerated with an inert material which is later separated from the powder after subjecting the powder to an annealing process.

20. The process according to claim 19, wherein the inert material comprises one or more stable oxides selected from the group consisting of silicon oxide, manganese oxide and chromium oxide.

21. The process according to claim 1, wherein the carbon content of the raw powder is between 0.2 and 0.7% by weight.

22. The process according to claim 1, wherein the oxygen/carbon weight ratio of the raw powder is between 1.5 and 3.5.

23. The process according to claim 1, wherein the oxygen/carbon weight ratio of the raw powder is between 2 and 3.

* * * * *